US012104868B2

(12) United States Patent
Lowell

(10) Patent No.: US 12,104,868 B2
(45) Date of Patent: Oct. 1, 2024

(54) WET MUZZLE DEVICE

(71) Applicant: Lirces 3, Macungie, PA (US)

(72) Inventor: Seth Alan Lowell, Macungie, PA (US)

(73) Assignee: Lirces 3, Macungie, PA (US)

( * ) Notice: Subject to any disclaimer, the term of this patent is extended or adjusted under 35 U.S.C. 154(b) by 29 days.

(21) Appl. No.: 17/903,755

(22) Filed: Sep. 6, 2022

(65) Prior Publication Data

US 2024/0077272 A1 Mar. 7, 2024

(51) Int. Cl.
*F41A 21/30* (2006.01)

(52) U.S. Cl.
CPC ..... *F41A 21/30* (2013.01)

(58) Field of Classification Search
None
See application file for complete search history.

(56) References Cited

U.S. PATENT DOCUMENTS

D271,655 S 12/1983 Numbers
4,454,798 A * 6/1984 Shea ..... F41A 21/30 181/223
4,530,417 A * 7/1985 Daniel ..... F41A 21/30 181/252
4,576,083 A * 3/1986 Seberger, Jr. ..... F01N 1/08 89/14.4
5,136,923 A * 8/1992 Walsh, Jr. ..... F41A 21/30 89/14.4
6,308,609 B1 * 10/2001 Davies ..... F41A 21/30 89/14.4
6,575,074 B1 * 6/2003 Gaddini ..... F41A 21/30 89/14.4
7,207,258 B1 * 4/2007 Scanlon ..... F41A 21/30 89/14.4
7,832,323 B1 * 11/2010 Davies ..... F41A 21/34 89/14.4
7,987,944 B1 * 8/2011 Brittingham ..... F41A 21/30 89/14.4
8,162,100 B2 * 4/2012 Shults ..... F41A 21/30 89/14.4
8,196,701 B1 * 6/2012 Oliver ..... F41A 21/30 89/14.4
9,347,727 B1 * 5/2016 Cler ..... F41A 21/30
9,441,900 B1 * 9/2016 Parrish ..... F41A 21/30
9,470,466 B2 10/2016 Washburn
10,030,929 B1 * 7/2018 Lessard ..... F41A 21/30
(Continued)

FOREIGN PATENT DOCUMENTS

EP 1764577 B1 11/2016

*Primary Examiner* — Derrick R Morgan

(57) ABSTRACT

A wet muzzle device configured to install along a firearm suppressor is presented. The wet muzzle device contains a fluid housing, a fluid retaining element, and an end cap. The fluid housing contains a first mounting end, a second mounting end, and a fluid chamber. The end cap comprises a bullet aperture. The fluid chamber is positioned within the fluid housing, where the fluid chamber is configured to provide ample clearance to secure the fluid retaining element within the fluid chamber. The first mounting end and the second mounting end are terminally positioned opposite to each other along the fluid housing. The fluid retaining element is positioned within the fluid chamber. The end cap is connected adjacent to the first mounting end. The bullet aperture is centrally positioned to the end cap.

17 Claims, 4 Drawing Sheets

(56) References Cited

U.S. PATENT DOCUMENTS

| | | | | |
|---|---|---|---|---|
| 10,119,779 | B1 * | 11/2018 | Miele | F41A 21/30 |
| 11,092,399 | B2 * | 8/2021 | Washburn, III | F41A 21/30 |
| 11,221,189 | B1 * | 1/2022 | Couvillion | F41A 21/30 |
| 11,435,155 | B2 * | 9/2022 | Washburn, III | F41A 21/30 |
| 11,435,156 | B1 * | 9/2022 | Dellinger | G10K 11/165 |
| 11,680,764 | B1 * | 6/2023 | Bray | F41A 21/32<br>181/223 |
| 2003/0145718 | A1 * | 8/2003 | Hausken | F41A 21/30<br>89/14.4 |
| 2011/0186377 | A1 * | 8/2011 | Kline | F41A 21/30<br>181/223 |
| 2012/0145478 | A1 * | 6/2012 | Brittingham | F41A 21/30<br>181/264 |
| 2012/0291614 | A1 * | 11/2012 | Koumbis | F41A 21/30<br>42/78 |
| 2013/0312592 | A1 * | 11/2013 | Storrs | F41A 21/30<br>89/14.4 |
| 2015/0308773 | A1 * | 10/2015 | Daniel | F41A 5/26<br>89/14.4 |
| 2015/0354422 | A1 * | 12/2015 | Liskey | F41A 21/30<br>89/14.4 |
| 2017/0307323 | A1 * | 10/2017 | Couvillion | F41A 21/36 |
| 2019/0017773 | A1 * | 1/2019 | Myers | F41A 21/30 |
| 2019/0186859 | A1 * | 6/2019 | Sautmann | F41A 21/30 |
| 2019/0277591 | A1 * | 9/2019 | Schwartzkopf | F41A 21/30 |
| 2021/0071978 | A1 * | 3/2021 | Washburn, III | F41A 21/30 |
| 2021/0389076 | A1 * | 12/2021 | Turnblom | F41A 21/36 |

* cited by examiner

WET MUZZLE DEVICE

FIELD OF THE INVENTION

The present invention relates to firearm muzzle devices. More specifically, the present invention relates to firearm muzzle devices configured to install along a firearm suppressor.

BACKGROUND OF THE INVENTION

Silencers can be shot wet which means adding water or a gel in 3-5 cc's into the exit point of the silencer. This is done for a few reasons, first that the liquid/gel absorbs and eliminates the first-round pop of silencers which is where the first shot through a silencer is noticeably louder than the follow-up shots. Second, the liquid/gel works to further suppress the shot reducing the overall decibel count. A muzzle brake is a device that normally attaches to the barrel of the rifle. A muzzle brake is designed to redirect or deflect the high-pressure and high-velocity gases of the gun either to the side or the rear. In conventional systems, liquid or gel is simply applied into the exit point of the silencer. This does not uniformly cover the inside of the silencer and large amounts of the liquid or gel is expended with each shot, limiting the number of wet shots to only 3-5 shots. Liquids such as water are also not contained in the silencer. The applied water tends to spill out of the silencer if the silencer is directed downwards. Gel can also leak out of the silencer if pointed down, but in a slower pace. Additionally, silencers are known for back pressure or gassing which redirects gas back to the shooters face. Therefore, it is an objective of the present invention to address these problems.

The present invention aims to solve these problems. The present invention is a device that attaches to the silencer in a variety of ways that adds a wet chamber that is specifically designed to allow uniform dispersion of water or gel and act as a muzzle break for the silencer. The present invention provides two to three times more wet shots compared to the conventional systems. The present invention retains applied liquid or gel medium in the silencer. The present invention also acts as a muzzle break for the silencer, reducing felt recoil and mitigating the amount of gas blowby returned to the shooters face. The present invention can be used in a way to reduce toxic fumes, reduce recoil, and work as a liquid trap to increase wet shot capabilities by swapping internal materials. The present invention can be configured to any configuration to accommodate any suitable task by swapping the internal materials. The present invention provides operator safety to the user and reduces toxic gas exposure.

SUMMARY OF THE INVENTION

The present invention is a wet muzzle device suitable for sustaining liquid medium in a firearm suppressor, allowing the firearm suppressor to sustain further wet shots. Additionally, the wet muzzle device serves as a firearm muzzle brake, where the wet muzzle device is configured to divert the gases exerted from a firearm in a configuration suitable for reducing felt recoil. The wet muzzle device comprises a fluid housing, a fluid retaining element, and an end cap. The fluid housing comprises a first mounting end, a second mounting end, and a fluid chamber. The end cap comprises a bullet aperture. In the preferred embodiment, the fluid chamber is positioned within the fluid housing, where the fluid chamber is configured to provide ample clearance to secure the fluid retaining element within the fluid chamber.

The first mounting end and the second mounting end are terminally positioned opposite to each other along the fluid housing. The fluid retaining element is positioned within the fluid chamber. The end cap is connected adjacent to the first mounting end. The bullet aperture is centrally positioned to the end cap.

DETAIL DESCRIPTIONS OF THE INVENTION

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention. References herein to "the preferred embodiment", "one embodiment", "some embodiments", or "alternative embodiments" should be considered to be illustrating aspects of the present invention that may potentially vary in some instances, and should not be considered to be limiting to the scope of the present invention as a whole.

Figure 1:
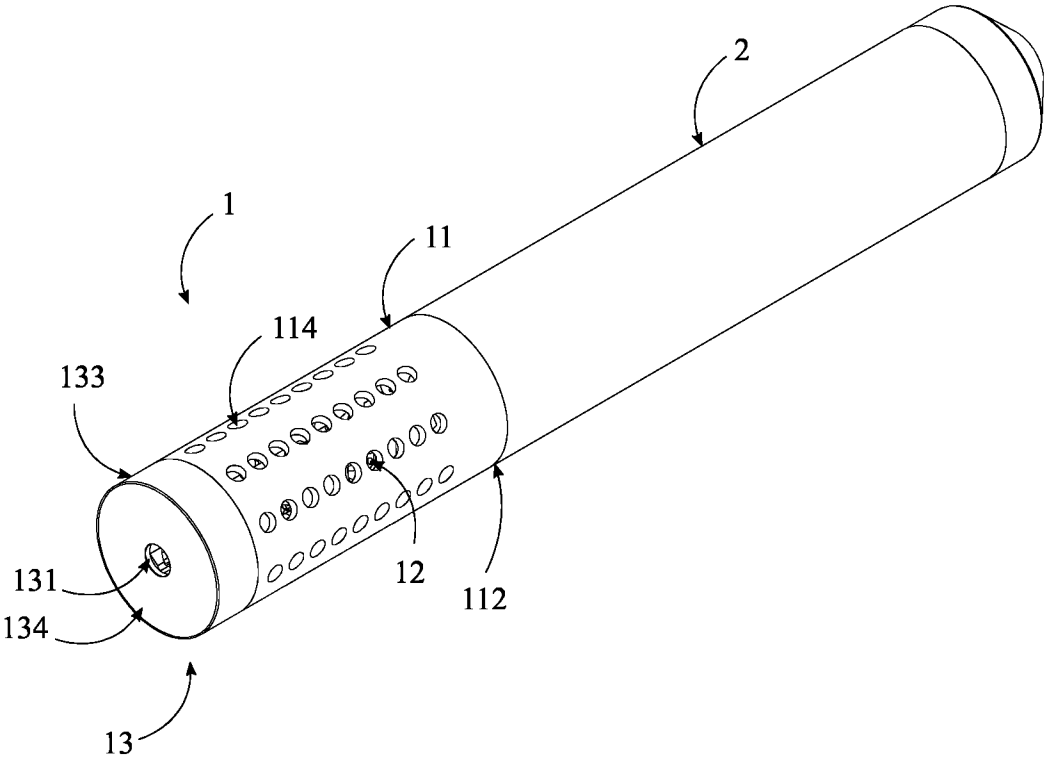
FIG. 1 is a top perspective view of the present invention.
Figure 2:
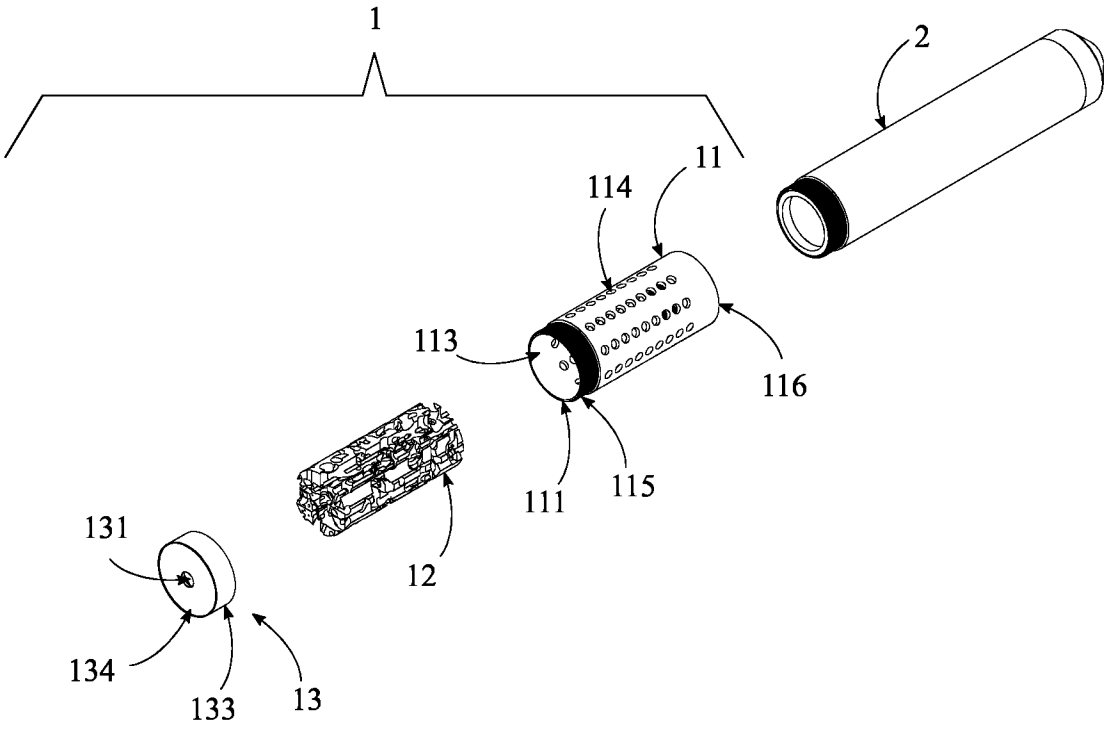
FIG. 2 is an exploded view of the present invention.
Figure 3:
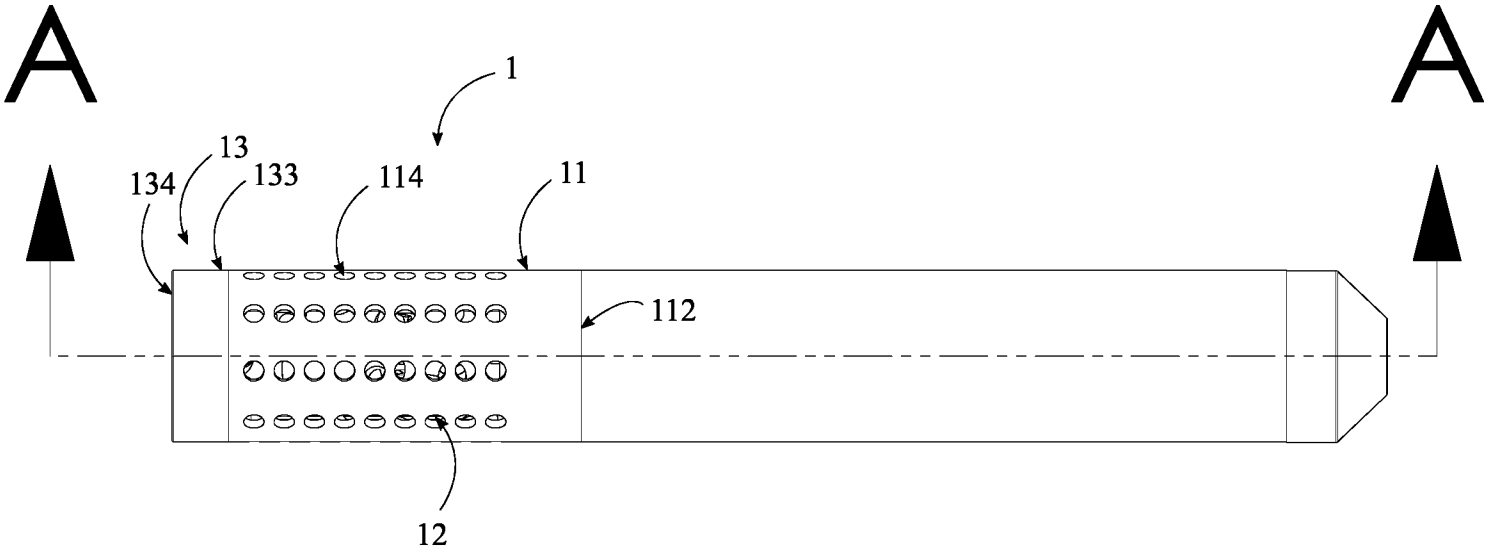
FIG. 3 is a side view of the present invention.
Figure 4:
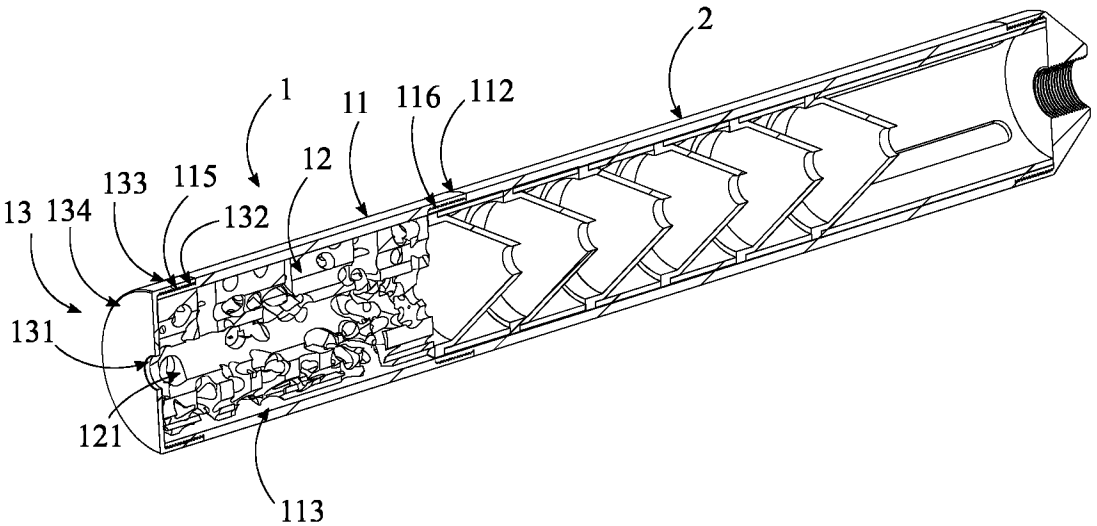
FIG. 4 is a cross sectional view of the present invention taken along line A-A in FIG. 3.

In reference to FIGS. 1-4, the present invention is a wet muzzle device 1 suitable for sustaining liquid medium in a firearm suppressor 2, allowing the firearm suppressor 2 to sustain further wet shots. Additionally, the wet muzzle device 1 serves as a firearm muzzle brake, where the wet muzzle device 1 is configured to divert the gases exerted from a firearm in a configuration suitable for reducing felt recoil. In the preferred embodiment, this liquid medium takes the form of any suitable liquid such as, but not limited to water, oils, gels, powder mixes, or any other liquid medium suitable for running the firearm suppressor 2 wet. The wet muzzle device 1 comprises a fluid housing 11, a fluid retaining element 12, and an end cap 13. The fluid housing 11 comprises a first mounting end 111, a second mounting end 112, and a fluid chamber 113. The end cap 13 comprises a bullet aperture 131. In the preferred embodiment, the fluid housing 11 takes the form of a cylindrical body that secures the components the constitutes the wet muzzle device 1. More specifically, the fluid housing 11 attaches and mounts along the firearm suppressor 2, where the fluid housing 11 is configured to position the fluid retaining element 12 along the bullet path of the firearm suppressor 2. In the preferred embodiment, the fluid housing 11 is made out of any suitable material such as but not limited to aluminum, stainless steel, titanium, or any other suitable material. In the preferred embodiment, the fluid retaining element 12 takes the form of a fluid retaining medium that captures, disperses, and sustains liquid medium suitable for subsequent wet shots out of the firearm suppressor 2. The fluid retaining element 12 takes the form of any suitable material such as, but not limited to metals, high temperature polymers, plastics, rubber, silicone, paper, porous material, sponge, steel wool, or any other suitable material that can capture, disperse, and sustain liquid medium. In another embodiment, the fluid retaining element 12 may take the form of an air particulate filtration unit suitable for capturing toxic particulates emitted from firearm discharge. In this embodiment, the fluid retaining element 12 is configured to contain, trap, and reduce dangerous gasses that the user encounters from continuous firearm discharge in enclosed areas. In the preferred embodiment, the end cap 13 takes the form of any suitable cap implement that encloses the fluid housing 11, securing the fluid retaining element 12 within the fluid housing 11. More specifically, the end cap 13 takes the form of a firearm suppressor 2 cap that withholds the fluid retaining element 12 within the fluid housing 11.

In one embodiment, the end cap 13 takes the form of the distal suppressor cap of the firearm suppressor 2. In another embodiment, the end cap 13 takes the form of a coupling implement that secures the fluid housing 11 between the firearm suppressor 2 and a firearm muzzle. In another embodiment, the end cap 13 takes the form of a coupling element, securing the fluid housing 11 between two firearm suppressor 2 sections.

In the preferred embodiment, the first mounting end 111 takes the form of any suitable mounting implement suitable for attaching the end cap 13 to the fluid housing 11. In the preferred embodiment, the second mounting end 112 takes the form of any suitable mounting implement suitable for attaching the fluid housing 11 to the firearm suppressor 2. In another embodiment, the second mounting end 112 is configured to attach the fluid housing 11 to the firearm muzzle.

In the preferred embodiment, the fluid chamber 113 is positioned within the fluid housing 11, where the fluid chamber 113 is configured to provide ample clearance to secure the fluid retaining element 12 within the fluid chamber 113. The first mounting end 111 and the second mounting end 112 are terminally positioned opposite to each other along the fluid housing 11. The fluid retaining element 12 is positioned within the fluid chamber 113. The end cap 13 is connected adjacent to the first mounting end 111. The bullet aperture 131 is centrally positioned to the end cap 13.

The fluid housing 11 further comprises a plurality of injection ports 114. The plurality of injection ports 114 is distributed about the fluid housing 11. In the preferred embodiment, the plurality of injection ports 114 takes the form of fluid input ports that allows the user to administer the liquid medium into the fluid housing 11 such that the fluid retaining element 12 absorbs, distributes, and retains the liquid medium along the fluid housing 11. In the preferred embodiment, the plurality of injection ports 114 is distributed in any suitably spaced pattern, enabling the user to apply the liquid medium along the span of the fluid housing 11.

The fluid housing 11 further comprises a first mounting element 115. The first mounting element 115 is connected adjacent to the first mounting end 111. The end cap 13 is connected adjacent to the first mounting element 115. In the preferred embodiment, the first mounting element 115 is a thread style mounting element. In various embodiments, the first mounting element 115 takes the form of any other suitable mounting element such as but not limited to locking lugs, latching mechanisms, or any other suitable mounting element. The fluid housing 11 comprises a second mounting element 116. The second mounting element 116 is connected adjacent to the second mounting end 112. In the preferred embodiment, the second mounting element 116 is a thread style mounting element. In various embodiments, the second mounting element 116 takes the form of any other suitable mounting element such as but not limited to locking lugs, latching mechanisms, or any other suitable mounting element.

The end cap 13 further comprises a third mounting element 132. The third mounting element 132 is connected adjacent to the end cap 13. The third mounting element 132 is removably attached to the first mounting element 115. In the preferred embodiment, the third mounting element 132 is a thread style mounting element. In various embodiments, the third mounting element 132 takes the form of any other suitable mounting element such as but not limited to locking lugs, latching mechanisms, or any other suitable mounting element. The end cap 13 further comprises a cap partition 133 and an end plate 134. In the preferred embodiment, the cap partition 133 serves as the walls of the end cap 13 that serves as the mounting platform for the third mounting element 132. The end plate 134 takes the form of the closed off body of the end cap 13 that accommodates the bullet aperture 131. The cap partition 133 is connected adjacent to the end plate 134. The bullet aperture 131 is centrally positioned to the end plate 134. The third mounting element 132 traverses along the cap partition 133.

The fluid retaining element 12 comprises a bullet channel 121. In the preferred embodiment, the bullet channel 121 takes the form of a central through hole with ample clearance for the bullet to pass through the fluid retaining element 12. The bullet channel 121 traverses through the fluid retaining element 12. The bullet channel 121 is concentrically aligned with the bullet aperture 131.

Although the invention has been explained in relation to its preferred embodiment, it is to be understood that many other possible modifications and variations can be made without departing from the spirit and scope of the invention as hereinafter claimed.

What is claimed is:

1. A wet muzzle device comprising:

a fluid housing;

a fluid retaining element;

an end cap;

the fluid housing comprising a first mounting end, a second mounting end, a fluid chamber, and a first mounting element;

the end cap comprising a cap partition and an end plate;

the fluid housing and the fluid retaining element being two functionally and physically different components;

the fluid chamber being positioned within the fluid housing;

the first mounting end and the second mounting end being positioned opposite to each other along the fluid housing;

the second mounting end being configured to removably attach to a firearm suppressor;

the fluid retaining element being positioned within the fluid chamber;

the fluid retaining element traversing from the first mounting end and the second mounting end;

the fluid retaining element being configured to capture, disperse, and sustain a liquid medium;

the fluid retaining element being further configured to filter particulate emitted from a firearm discharge;

the first mounting element being connected adjacent to the first mounting end;

the end cap being connected adjacent to the first mounting element;

the first mounting element being a male threading;

the cap partition being connected adjacent to the end plate; and the bullet aperture being centrally positioned to the end plate.

2. The wet muzzle device as claimed in claim 1 comprising:

the end cap further comprising a bullet aperture; and the bullet aperture being centrally positioned to the end cap.

3. The wet muzzle device as claimed in claim 1 comprising:

the fluid housing further comprising a plurality of injection ports; and the plurality of injection ports being distributed about the fluid housing.

4. The wet muzzle device as claimed in claim 1 comprising:

the fluid housing further comprising a second mounting element; and the second mounting element being connected adjacent to the second mounting end.

5. The wet muzzle device as claimed in claim 4, wherein the second mounting element is a female threading.

6. The wet muzzle device as claimed in claim 1 comprising:

the end cap further comprising a third mounting element;

the third mounting element being connected adjacent to the end cap;

the third mounting element being removably attached to the first mounting element; and the third mounting element traversing along the cap partition.

7. The wet muzzle device as claimed in claim 6, wherein the third mounting element is a female threading.

8. The wet muzzle device as claimed in claim 1 comprising:

the fluid retaining element comprising a bullet channel;

the bullet channel traversing through the fluid retaining element; and the bullet channel being concentrically aligned with the bullet aperture.

9. A wet muzzle device comprising:

a fluid housing;

a fluid retaining element;

an end cap;

the fluid housing comprising a first mounting end, a second mounting end, a plurality of injection ports, a fluid chamber, and a first mounting element;

the end cap comprising a bullet aperture, a cap partition, and an end plate;

the fluid housing and the fluid retaining element being two functionally and physically different components;

the fluid chamber being positioned within the fluid housing;

the plurality of injection ports being distributed about the fluid housing;

the first mounting end and the second mounting end being positioned opposite to each other along the fluid housing;

the second mounting end being configured to removably attach to a firearm suppressor;

the fluid retaining element being positioned within the fluid chamber;

the fluid retaining element traversing from the first mounting end and the second mounting end;

the fluid retaining element being configured to capture, disperse, and sustain a liquid medium;

the fluid retaining element being further configured to filter particulate emitted from a firearm discharge;

the first mounting element being connected adjacent to the first mounting end;

the end cap being connected adjacent to the first mounting element;

the bullet aperture being centrally positioned to the end cap;

the first mounting element being a male threading;

the cap partition being connected adjacent to the end plate; and the bullet aperture being centrally positioned to the end plate.

10. The wet muzzle device as claimed in claim 9 comprising:

the fluid retaining element comprising a bullet channel;

the bullet channel traversing through the fluid retaining element; and the bullet channel being concentrically aligned with the bullet aperture.

11. The wet muzzle device as claimed in claim 9 comprising:

the fluid housing comprising a second mounting element;

the end cap further comprising a third mounting element;

the second mounting element being connected adjacent to the second mounting end;

the third mounting element being connected adjacent to the end cap;

the third mounting element being removably attached to the first mounting element; and the third mounting element traversing along the cap partition.

12. The wet muzzle device as claimed in claim 11, wherein the second mounting element and the third mounting element each are a female threading.

13. A wet muzzle device comprising:

a fluid housing;

a fluid retaining element;

an end cap;

the fluid housing comprising a first mounting end, a second mounting end, a fluid chamber, and a first mounting element;

the end cap comprising a bullet aperture, a cap partition and an end plate;

the fluid retaining element comprising a bullet channel;

the fluid housing and the fluid retaining element being two functionally and physically different components;

the fluid chamber being positioned within the fluid housing;

the first mounting end and the second mounting end being positioned opposite to each other along the fluid housing;

the second mounting end being configured to removably attach to a firearm suppressor;

the fluid retaining element being positioned within the fluid chamber;

the fluid retaining element traversing from the first mounting end and the second mounting end;

the fluid retaining element being configured to capture, disperse, and sustain a liquid medium;

the fluid retaining element being further configured to filter particulate emitted from a firearm discharge;

the first mounting element being connected adjacent to the first mounting end;

the end cap being connected adjacent to the first mounting element;

the bullet aperture being centrally positioned to the end cap;

the first mounting element being a male threading;

the cap partition being connected adjacent to the end plate;

the bullet aperture being centrally positioned to the end plate;

the bullet channel traversing through the fluid retaining element; and the bullet channel being concentrically aligned with the bullet aperture.

14. The wet muzzle device as claimed in claim 13 comprising:

the fluid housing further comprising a plurality of injection ports; and the plurality of injection ports being distributed about the fluid housing.

15. The wet muzzle device as claimed in claim 13 comprising:

the fluid housing comprising a second mounting element;

the second mounting element being connected adjacent to the second mounting end; and the second mounting element being a female threading.

16. The wet muzzle device as claimed in claim 13 comprising:

the end cap further comprising a third mounting element;

the third mounting element being connected adjacent to the end cap; and the third mounting element being removably attached to the first mounting element; and the third mounting element traversing along the cap partition.

17. The wet muzzle device as claimed in claim 16, wherein the third mounting element is a female threading.

* * * * *